US005568950A

United States Patent [19]

Herren

[11] Patent Number: 5,568,950

[45] Date of Patent: Oct. 29, 1996

[54] HAND HELD BALLOON TYING DEVICE

[75] Inventor: Gerald R. Herren, South Baxter, Tenn.

[73] Assignee: H & M Enterprises, Inc., Cookeville, Tenn.

[21] Appl. No.: 618,288

[22] Filed: Mar. 18, 1996

[51] Int. Cl.[6] ..... D03J 3/00

[52] U.S. Cl. ..... 289/17; 63/1.1

[58] Field of Search ..... 289/17, 18.1, 2, 289/1.5; 446/220, 222; 63/1.1, 15

[56] References Cited

U.S. PATENT DOCUMENTS

| | | | |
|---|---|---|---|
| 888,580 | 5/1908 | Brinn | 63/1.1 |
| 1,008,190 | 11/1911 | O'Connell | 289/17 |
| 1,731,574 | 10/1929 | House | 63/1.1 |
| 3,177,021 | 4/1965 | Benham | 289/17 |
| 3,572,788 | 3/1971 | Cruzan | 289/17 |
| 3,837,691 | 9/1974 | Smythe | 289/17 |
| 4,029,346 | 6/1977 | Browning | 289/17 |
| 4,864,762 | 9/1989 | Cox | 43/4 |
| 4,989,906 | 2/1991 | Peverley | 289/17 |
| 5,039,142 | 8/1991 | Muma | 289/17 |
| 5,314,217 | 5/1994 | Place | 289/17 |

*Primary Examiner*—Michael A. Neas
*Attorney, Agent, or Firm*—Joseph A. Marasco

[57] ABSTRACT

A knot tying device includes a base adapted for attaching firmly to a human hand by sliding over at least one finger; and a cantilever supported by the base and protruding away from the palm of the hand, the cant/lever having a U-shaped cross section, the cantilever having a proximal region closest to the base and a distal region, the proximal region having two ears defining generally parallel planes extending outwardly therefrom, each of the ears terminating in a distal retaining edge for retaining a loop of balloon material, the cantilever defining inside the U-shape an axially oriented recess at least ⅝ inch wide, the recess extending from the proximal region and between the ears to the distal region.

3 Claims, 7 Drawing Sheets

HAND HELD BALLOON TYING DEVICE

FIELD OF THE INVENTION

The present invention relates to :devices for aiding in tying knots, and more particularly to devices for aiding in hand-tying half-hitch knots, especially in balloons and the like.

BACKGROUND OF THE INVENTION

Balloons and the like are generally tied with a half-hitch knot. First, a loop is made, passing the end over the standing part, then passing the end under the standing part and through the loop. See *The World Book Dictionary,* Clarence L. Barnhart and Robert K. Barnhart, editors, World Book, Inc., publisher, 1990, page 956, column 3. The loop is usually made around one or more fingers, which has disadvantages, among which are:

1. Difficulty of passing the end through the loop, because the material is generally kept very tight to prevent air or gas from escaping from the balloon.
2. Damage to the material while tying the knot therein.
3. Fatigue of the hands, especially the fingers, due to tying many balloons.
4. Extra time is often required to avoid or cope with the above listed disadvantages.

There are various commercially available devices which can be attached to the open ends of balloons to seal the air or gas there inside. Such products do not relate to the invention because when such devices are removed from the balloon, the air or gas escapes therefrom.

Other devices, such as that disclosed by Peverley in U.S. Pat. No. 4,989,906, issued on Feb. 5, 1991, attach to fixed support means via a bracket. Such devices are not generally portable since they must be secured to a fixed support. There is a need for a balloon tying device which can be held in the hand while operated with both hands to facilitate easy tying of balloons.

See also: U.S. Pat. No. 5,314,217 to Place, issued on May 24, 1994; U.S. Pat. No. 5,03,142 to Muma, issued on Aug. 13, 1991; U.S. Pat. No. 4,864,762 to Cox, issued on Sep. 12, 1989; U.S. Pat. No. 4,029,346 to Browning, issued on Jun. 14, 1977; U.S. Pat. No. 3,837,691 to Smythe, issued on Sep. 24, 1974; and U.S. Pat. No. 1,008,190 to O'Connell, issued on Nov. 7, 1911.

OBJECTS OF THE INVENTION

Accordingly, it is an object of the present invention to provide a portable, hand held device for aiding in tying knots in balloons and the like, having advantages of ease of passing the end through the loop, avoiding damage to the material while tying the knot therein, and avoiding fatigue of the hands and fingers due to tying many balloons.

Further and other objects of the present invention will become apparent from the description contained herein.

SUMMARY OF THE INVENTION

In accordance with one aspect of the present invention, the foregoing and other objects are achieved by a knot tying device comprising:

a base adapted for attaching firmly to a human hand by sliding over at least one finger; and a cantilever supported by the base and protruding away from the palm of the hand, the cantilever having a U-shaped cross section, the cantilever having a proximal region closest to the base and a distal region, the proximal region having two ears defining generally parallel planes extending outwardly therefrom, each of the ears terminating in a distal retaining edge for retaining a loop of balloon material, the cantilever defining inside the U-shape an axially oriented recess at least ⅝ inch wide, the recess extending from the proximal region and between the ears to the distal region.

Figure 2:
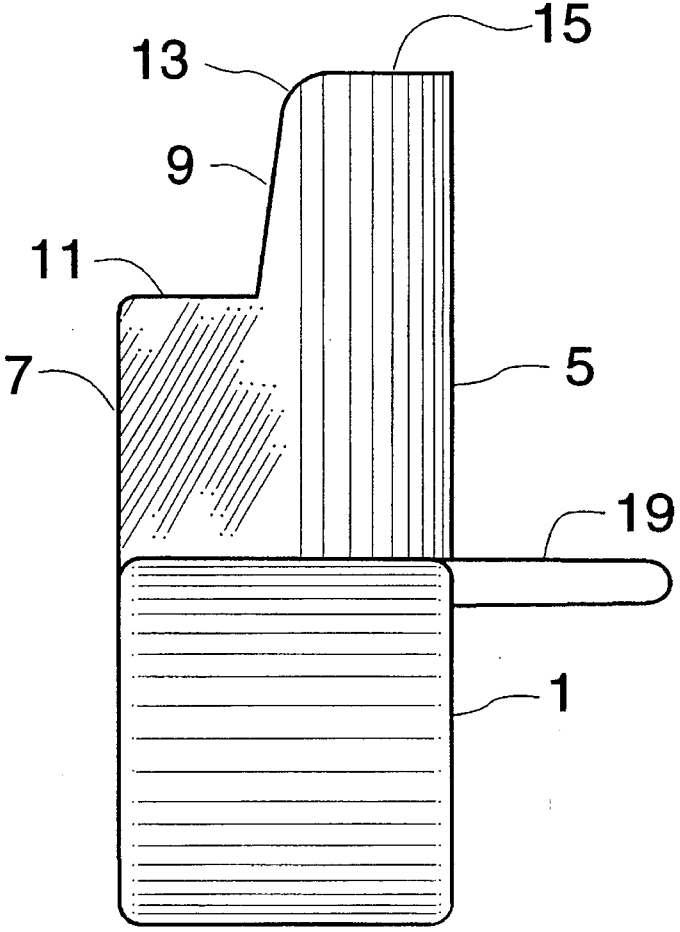
FIG. 2 is a side view of an embodiment of the invention.
Figure 1:
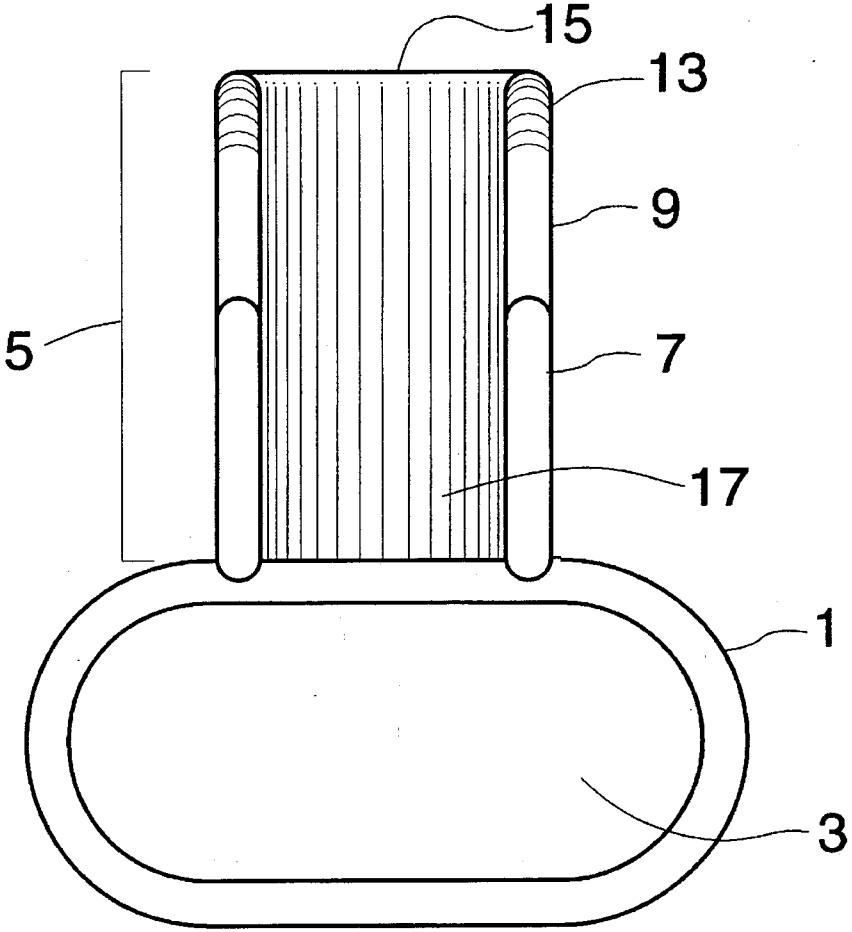
FIG. 1 is a front view of an embodiment of the invention.
Figure 3:
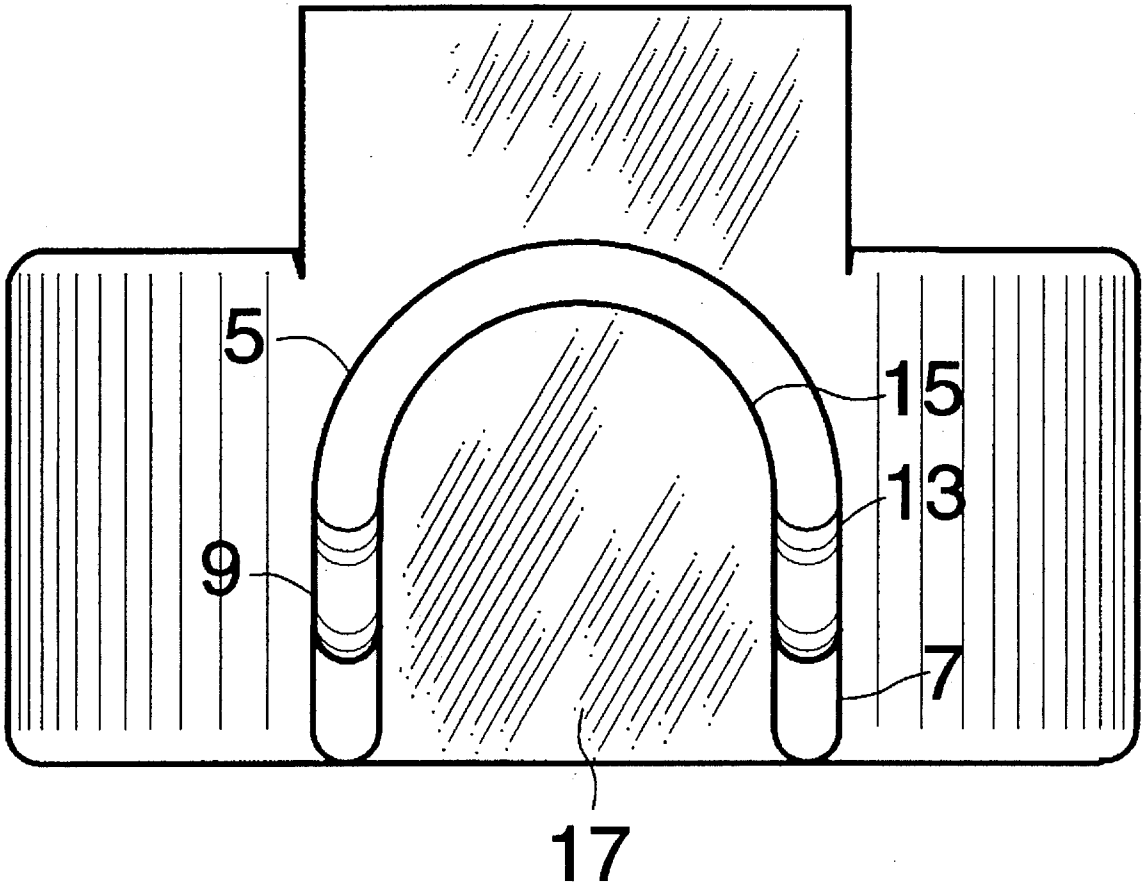
FIG. 3 is an top view of an embodiment of the invention.
Figure 4:
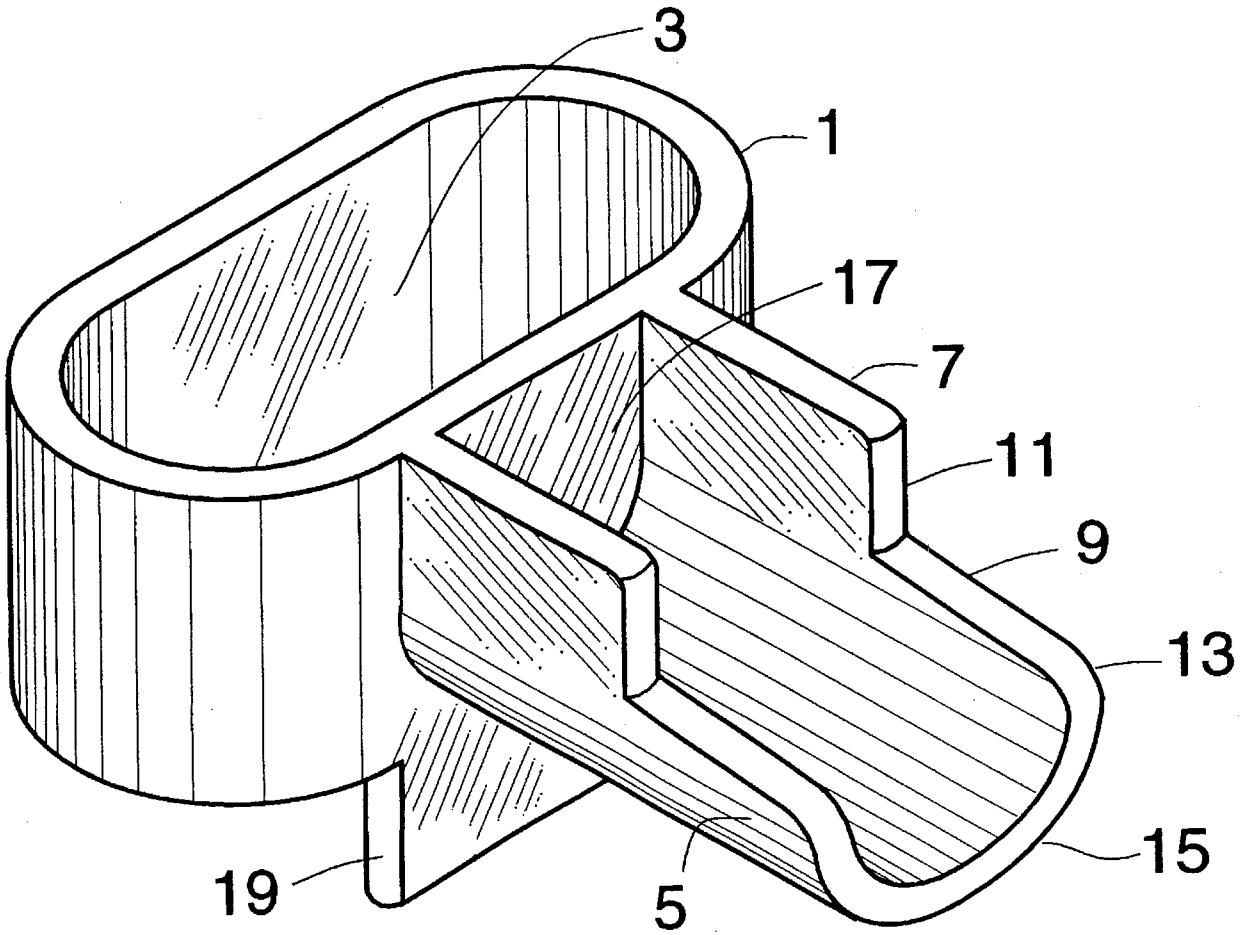
FIG. 4 is a isometric view of an embodiment of the invention.

For a better understanding of the present invention, together with other and further objects, advantages and capabilities thereof, reference is made to the following disclosure and appended claims in connection with the above-described drawings.

DETAILED DESCRIPTION OF THE INVENTION

Referring to FIGS. 1–4, one embodiment of the invention includes a base 1 which supports a cant/lever 5. The base 1 is hollow as shown, having an opening 3 to slide over the fingers, preferably first and second, of a human hand.

The cantilever 5 has a U-shaped cross section. Proximal to the base 1, each side of the cant/lever has an ear 7 which terminates in a retaining edge 11. The two ears 7 and two retaining edges 11 are generally parallel due to the U-shape of the cantilever 5. The purpose of the retaining edges 11 is to keep the balloon tying operation sufficiently above the hand to allow sufficient clearance for manipulation of the balloon with the other hand.

Above each ear 7 is a preferably slightly back slanted holding edge 9 which extends to the end 15 of the cant/lever 5. Near the end 15, the holding edge 9 preferably has a radius 13 for ensuring that the balloon is not damaged upon removal from the device. The purpose of the holding edges 9 is to provide an opening therebetween to allow sufficient clearance for manipulation of the balloon through the opening with the other hand. The back slanting is for facilitating easy removal of a tied balloon.

An axially oriented recess 17 extends from the base and between the ears 7 and holding edges 9 to the end 15 for proving an opening through which a finger of the other hand can push the end of a balloon in order to complete a knot. The recess 17 should therefore be at least ⅝ inch wide, and preferably ¾ inch wide to fit most normal sized human fingers.

A brace tab 19 preferably extends from the base 1 toward the palm of the hand helps to provide for firm attachment to the hand.

Many, if not all, corners and edges of the device are preferably rounded as shown in the drawings to ensure comfort and ease of use.

The device is preferably constructed of plastic, and is preferably fabricated by one piece molding. However, any suitable conventional material can be used, and any suitable conventional fabrication means can be used.

Figure 5:
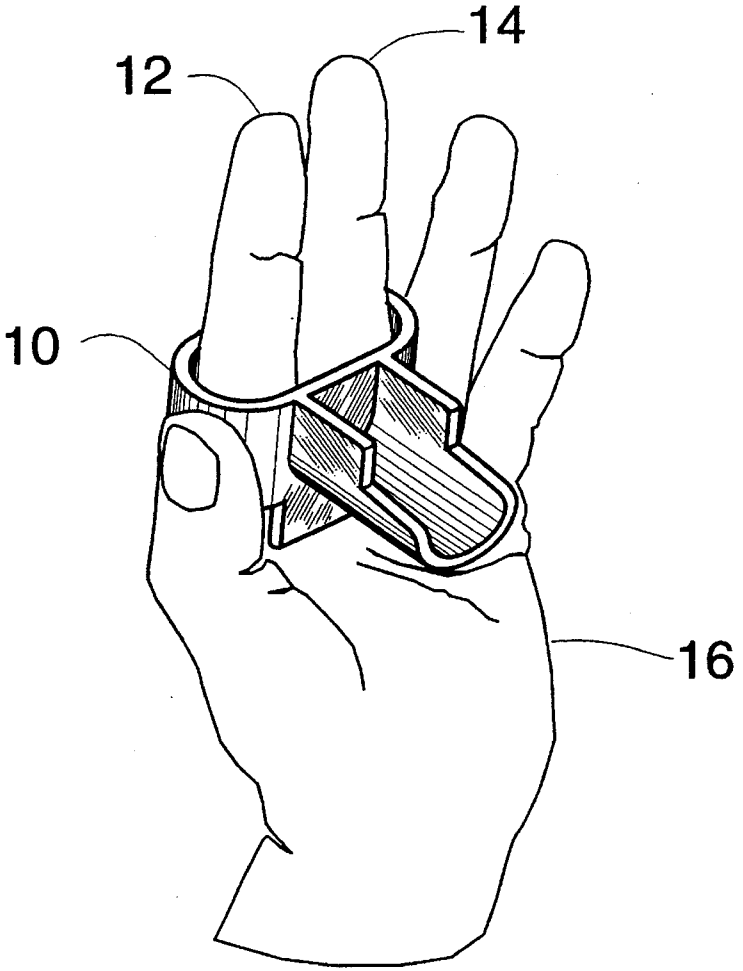
FIGS. 5–8 show four sequential steps in a method of using the invention to tie a knot in a balloon.

The device can be used to tie a knot in any material which can be wrapped around the cantilever and passed through the recess 17. A preferred method of using the device is illustrated in sequential FIGS. 5–8. Referring to FIG. 5, an embodiment 10 of the invention as described hereinabove is slid over two fingers 12, 14 of one hand 16 as shown. The invention can be used in this manner over any one or more fingers.

Figure 6:
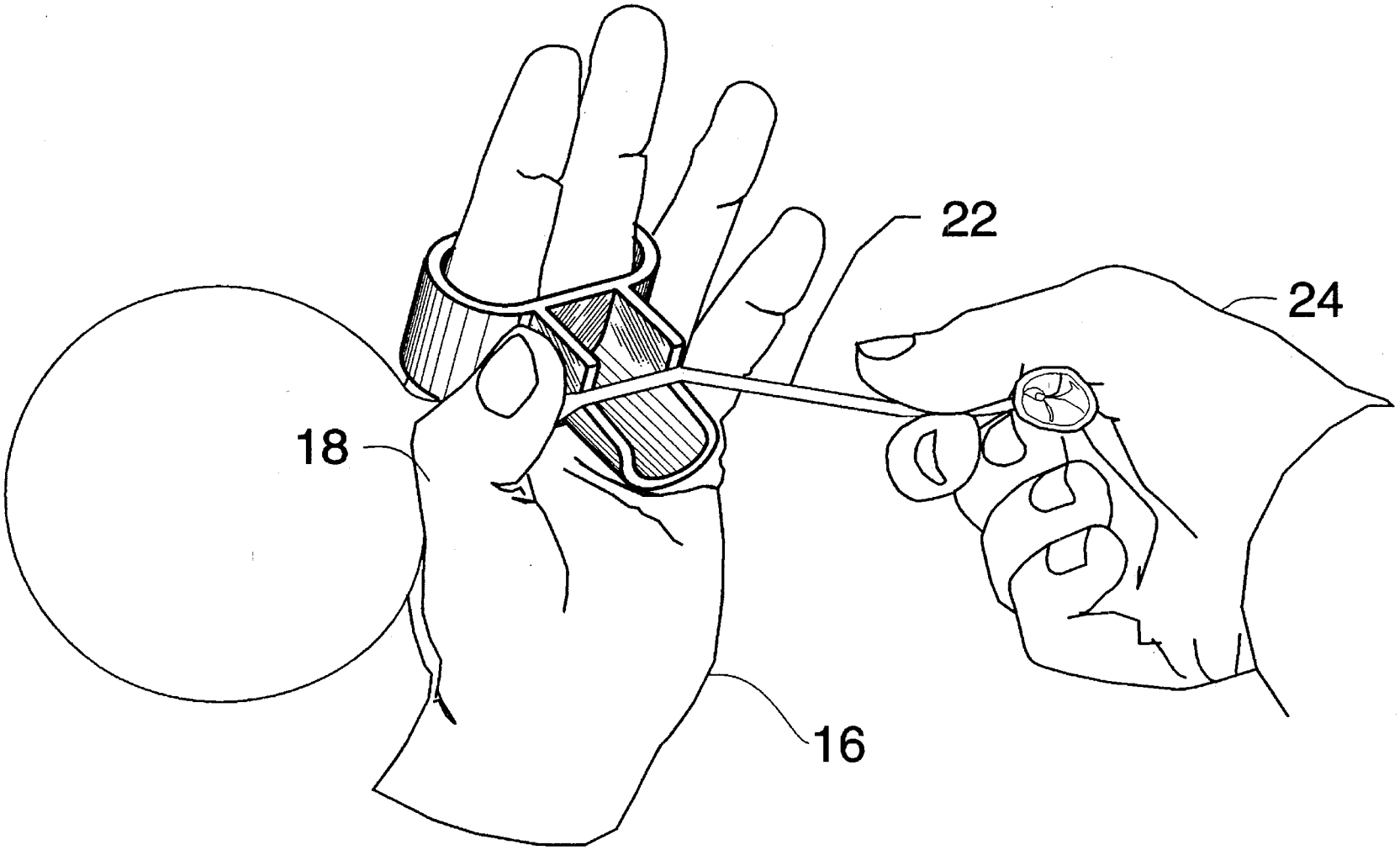
Figure 7:
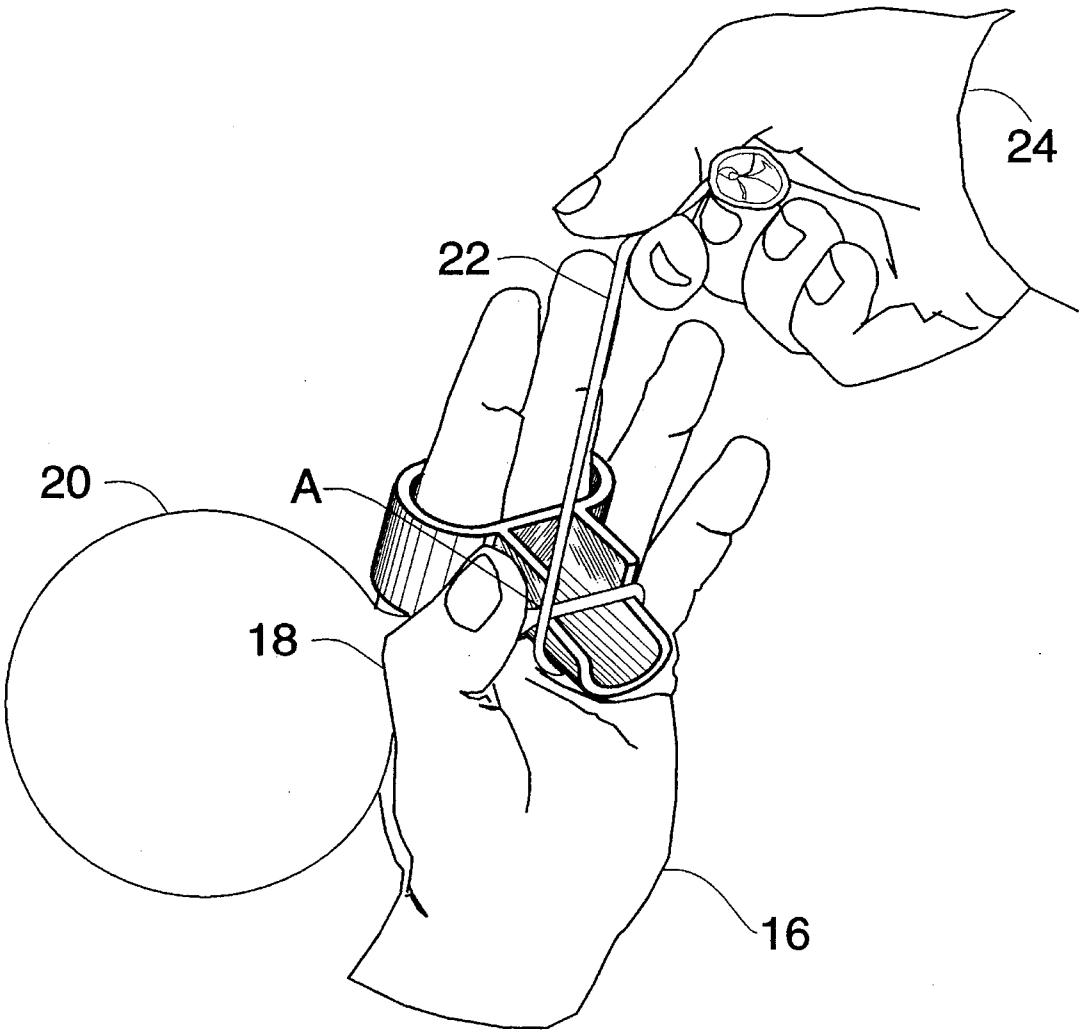
Figure 8:
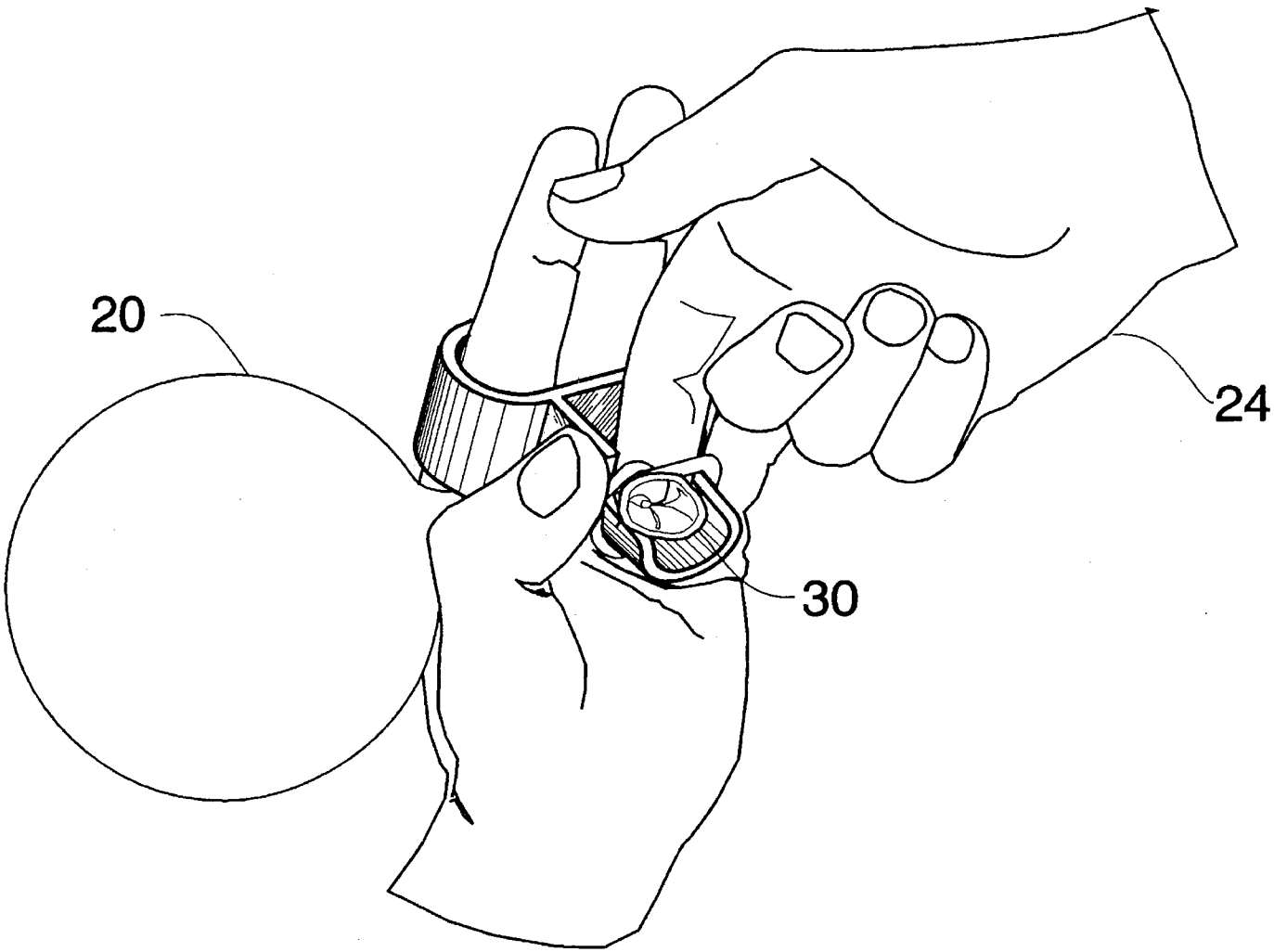

Referring next to FIGS. 6 and 7, an inflated balloon 20 is held with the thumb 18 of the one hand 16, whilst the open end 22 thereof is stretched across the two holding edges 9 just distally of the retaining edges 11. Then the open end 22 is wrapped around the cantilever 5 until it crosses over itself at point A. Referring next to FIG. 8, the open end is passed under itself, then upwardly through the recess 17, forming a half-hitch knot 30 around the cantilever 5. The knot 30 is then easily slid distally off the cantilever 5 and rapidly pulled to tightness to complete the half-hitch knot in the balloon to seal the same and hold compressed air or gas therein. The knot can also be tied by crossing under itself and downwardly through the recess 17.

While there has been shown and described what are at present considered the preferred embodiments of the invention, it will be obvious to those skilled in the art that various changes and modifications can be made therein without departing from the scope of the inventions defined by the appended claims.

What is claimed is:

1. A knot tying device comprising:

a base adapted for attaching firmly to a human hand by sliding over at least one finger; and a cantilever supported by said base and protruding away from the palm of the hand, said cantilever having a U-shaped cross section, said cantilever having a proximal region closest to said base and a distal region, said proximal region having two ears defining generally parallel planes extending outwardly therefrom, each of said ears terminating in a distal retaining edge for retaining a loop of balloon material, said cantilever defining inside said U-shape an axially oriented recess at least ⅝ inch wide, said recess extending from said proximal region and between said ears to said distal region.

2. A knot tying device in accordance with claim 1 wherein said retaining edges are parallel.

3. A knot tying device in accordance with claim 1 further comprising a brace tab extending from said base toward the palm of the hand.

* * * * *